US006019262A

United States Patent [19]

Kiselik

[11] Patent Number: 6,019,262

[45] Date of Patent: Feb. 1, 2000

[54] SHOULDER GUARD WITH TIE ACCOMODATION

[76] Inventor: Daniel R. Kiselik, 11 Eliot Pl., Short Hills, N.J. 07078-3101

[21] Appl. No.: 09/234,384

[22] Filed: Jan. 20, 1999

[51] Int. Cl.[7] ..... A47G 25/20

[52] U.S. Cl. ..... 223/98; 223/87

[58] Field of Search ..... 223/98, 87, 85; D6/315

[56] References Cited

U.S. PATENT DOCUMENTS

| | | | |
|---|---|---|---|
| 1,201,195 | 10/1916 | Kinsinger, Sr. . | |
| 1,715,004 | 5/1929 | Johnson . | |
| 1,749,238 | 3/1930 | Wordingham | 223/98 |
| 2,210,490 | 8/1940 | Leonardson . | |
| 2,434,461 | 1/1948 | Forcheimer . | |
| 2,533,864 | 12/1950 | Wordingham . | |
| 2,581,631 | 1/1952 | Carta . | |
| 2,873,054 | 2/1959 | Zintel . | |
| 3,153,499 | 10/1964 | Babskin et al. | 223/98 |
| 3,155,296 | 11/1964 | Calder . | |
| 3,179,315 | 4/1965 | Sieradzki . | |
| 3,373,878 | 3/1968 | Daitch . | |
| 4,632,287 | 12/1986 | Bevelander . | |
| 4,940,174 | 7/1990 | Parker . | |
| 4,944,436 | 7/1990 | Moen et al. | 223/98 |
| 4,988,022 | 1/1991 | Seitz . | |
| 5,136,184 | 8/1992 | Seitz | 223/98 |
| 5,388,734 | 2/1995 | Seitz | 223/98 |
| 5,390,835 | 2/1995 | Murphy et al. | 223/98 |
| 5,577,645 | 11/1996 | Seitz . | |

*Primary Examiner*—Bibhu Mohanty
*Attorney, Agent, or Firm*—Arthur Jacob

[57] ABSTRACT

A shoulder guard for a wire garment hanger has an opening for the hook of the hanger, the dimensions, location and configuration of the opening providing access to a throat of the hanger, located at the intersection of the hook with shoulder portions of the hanger, for facilitating threading of a tie through the throats of adjacent hangers in a group to secure together the group of adjacent hangers, and the garments draped over the hangers. A blank from which the shoulder guard is erected is constructed with an aperture located, dimensioned and configured for establishing the opening in the erect shoulder guard.

17 Claims, 5 Drawing Sheets

SHOULDER GUARD WITH TIE ACCOMODATION

The present invention relates generally to shoulder guards for placement upon wire garment hangers and pertains, more specifically, to a departure in the construction of such shoulder guards for accommodating the use of a tie to secure together a plurality of adjacent, juxtaposed garments hung on wire garment hangers.

Shoulder guards commonly are used in garment handling establishments to store and transport garments on wire garment hangers. Usually, a shoulder guard is placed over a wire garment hanger and a garment is draped over the assembled shoulder guard and wire hanger so as to protect against unwanted distortion and creasing of the garment, thereby preserving the desired contour of a hung garment while stored or transported on the garment hanger. In many instances, a plurality of juxtaposed garments hung on adjacent garment hangers will be secured together, as with a wire twist-tie, to render more convenient the handling of a group of related garments. For example, garments in a dry-cleaning establishment routinely are grouped by customer and a plurality of garments delivered to a single customer often are tied together for ease of identification and handling.

The present invention provides a departure in the construction of shoulder guards for facilitating the use of a tie to secure together adjacent wire garment hangers which utilize shoulder guards. As such, the present invention attains several objects and advantages, some of which are summarized as follows: Facilitates the use of a tie to secure together wire garment hangers over which shoulder guards are placed for supporting a plurality of juxtaposed garments on a group of adjacent corresponding wire garment hangers; provides wire garment hangers with all of the advantages of an appropriate shoulder guard while enabling the use of commonly available wire twist-ties to secure together a group of adjacent wire garment hangers with garments supported thereon; allows increased ease in securing together a plurality of garments hung on wire garment hangers for storage and transport as an integrated group; accommodates commonly available wire garment hangers without requiring modification or special skills; enables increased convenience in the handling of garments stored or transported on wire garment hangers; allows the use of a common tie to secure together a plurality of juxtaposed garments hung on adjacent wire garment hangers quickly, with increased ease and economy, and with a high degree of integrity and effectiveness.

The above objects and advantages, as well as further objects and advantages, are attained by the present invention which may be described briefly as a shoulder guard for draping over a wire hanger having a central hook extending altitudinally, shoulder supports extending generally longitudinally between the hook and longitudinally opposite ends, and an open throat extending altitudinally and longitudinally between the hook and the shoulder supports, the shoulder guard including longitudinally opposite ends, a front panel having longitudinally opposite front end edges, a front upper edge, a front lower edge, and an altitudinal height between the front lower edge and the front upper edge, a rear panel having longitudinally opposite rear end edges, a rear upper edge, a rear lower edge, and an altitudinal height between the rear lower edge and rear upper edge, and a generally central opening for reception of the hook of the hanger when shoulder guard is draped over the shoulder supports of the hanger with the hook extending through the opening, the shoulder guard enabling a plurality of laterally juxtaposed wire hangers with corresponding shoulder guards draped over the juxtaposed wire hangers to be tied together with a common tie, the shoulder guard comprising: the opening extending longitudinally between the longitudinally opposite ends and extending altitudinally downwardly from the front upper edge and the rear upper edge toward the front lower edge and the rear lower edge along altitudinal distances great enough such that upon draping the shoulder guard over the shoulder supports of the wire hanger, with the hook of the wire hanger extending altitudinally through the opening, the throat of the wire hanger is exposed sufficiently for facilitating threading of the tie laterally through the throat of each juxtaposed wire hanger to tie together the juxtaposed wire hangers and corresponding shoulder guards.

Further, the present invention provides a blank from which a shoulder guard is erected for draping over a wire hanger having a central hook extending altitudinally, shoulder supports extending generally longitudinally between the hook and longitudinally opposite ends, and an open throat extending altitudinally and longitudinally between the hook and the shoulder supports, the blank being essentially flat and having an outer periphery, a generally central aperture for reception of the hook of the hanger, and fold lines about which the blank is folded to erect the shoulder guard for draping over the shoulder supports of the hanger when the hook is extended through the aperture, the blank enabling a plurality of laterally juxtaposed wire hangers with corresponding shoulder guards draped over the juxtaposed wire hangers to be tied together with a common tie, the blank comprising: a peripheral edge extending around the entire blank, along the periphery of the blank; and the aperture having a perimeter extending around the entire aperture, the perimeter being spaced from the peripheral edge of the blank along longitudinal and lateral distances for proscribing an area spaced longitudinally and laterally from the peripheral edge of the blank, the area being great enough such that upon folding the blank along the fold lines to erect the shoulder guard and draping the erected shoulder guard over the shoulder supports of the wire hanger, with the hook of the wire hanger extending altitudinally through the aperture, the throat of the wire hanger is exposed sufficiently for facilitating threading of the tie laterally through the throat of each juxtaposed wire hanger to tie together the juxtaposed wire hangers and corresponding shoulder guards.

The invention will be understood more fully, while still further objects and advantages will become apparent, in the following detailed description of preferred embodiments of the invention illustrated in the accompanying drawing, in which.

Figure 1:
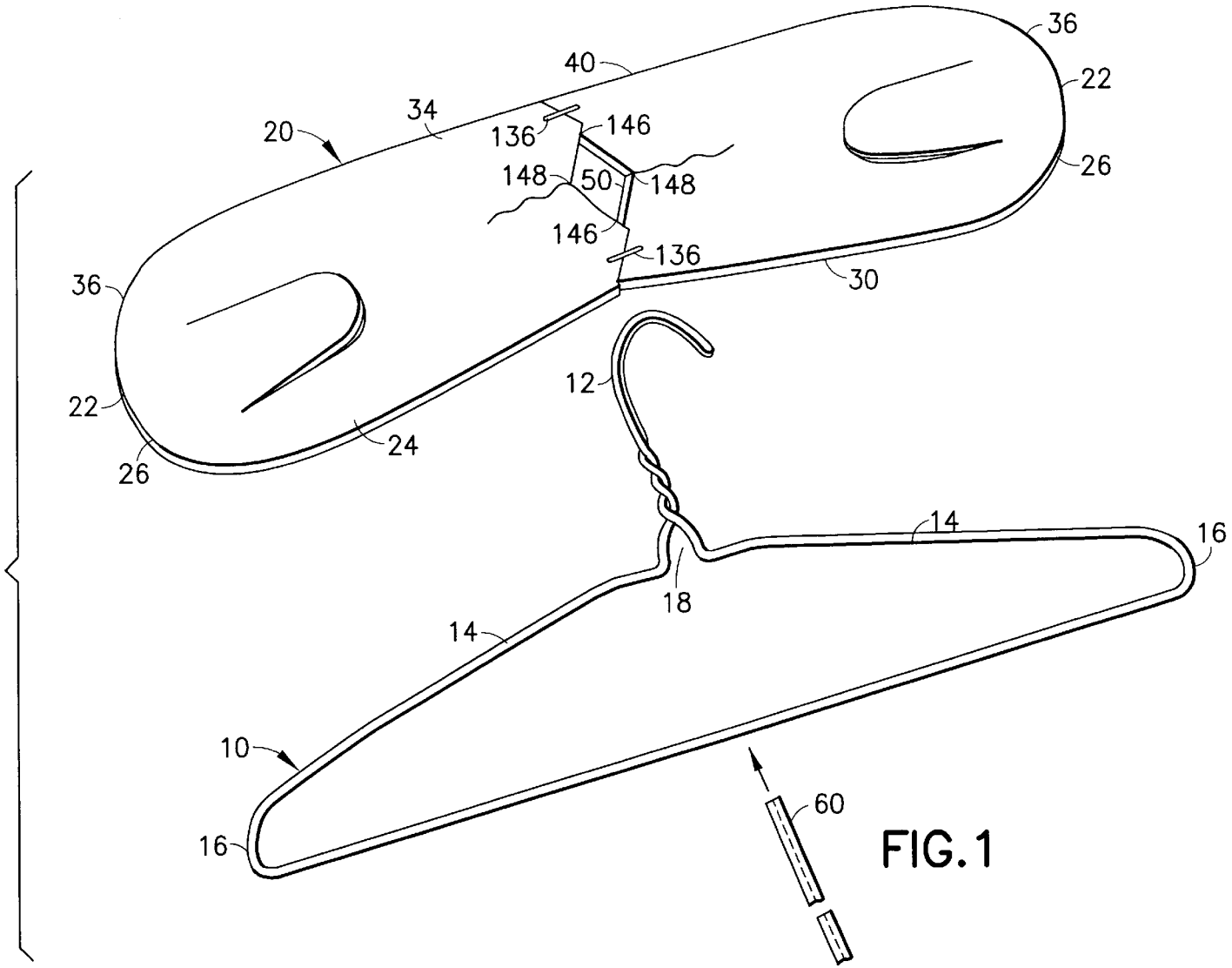
FIG. 1 is an exploded perspective view showing a shoulder guard constructed in accordance with the present invention about to be assembled with a wire garment hanger.
Figure 2:
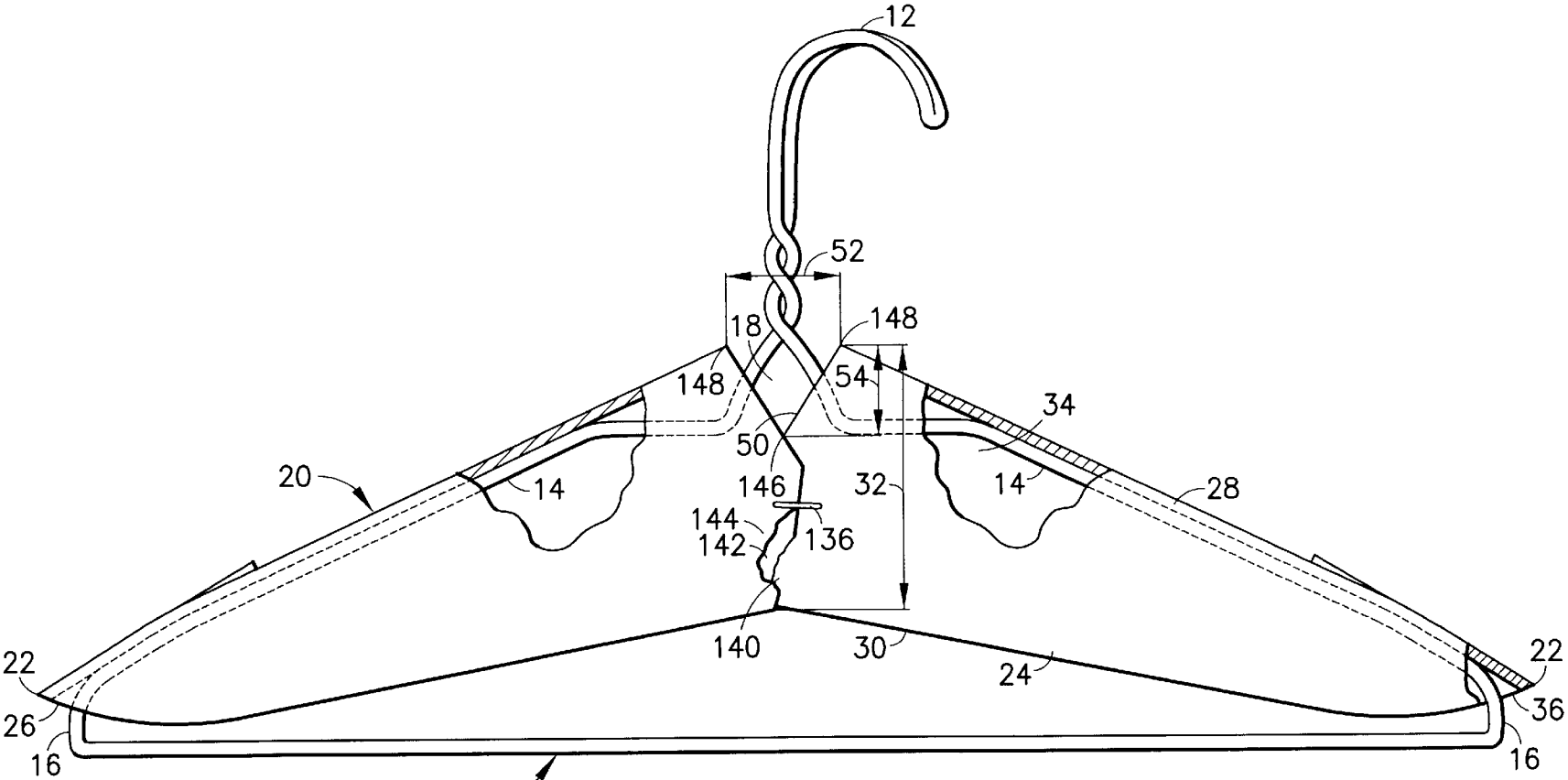
FIG. 2 is a front elevational view of the shoulder guard assembled with the wire garment hanger.
Figure 3:
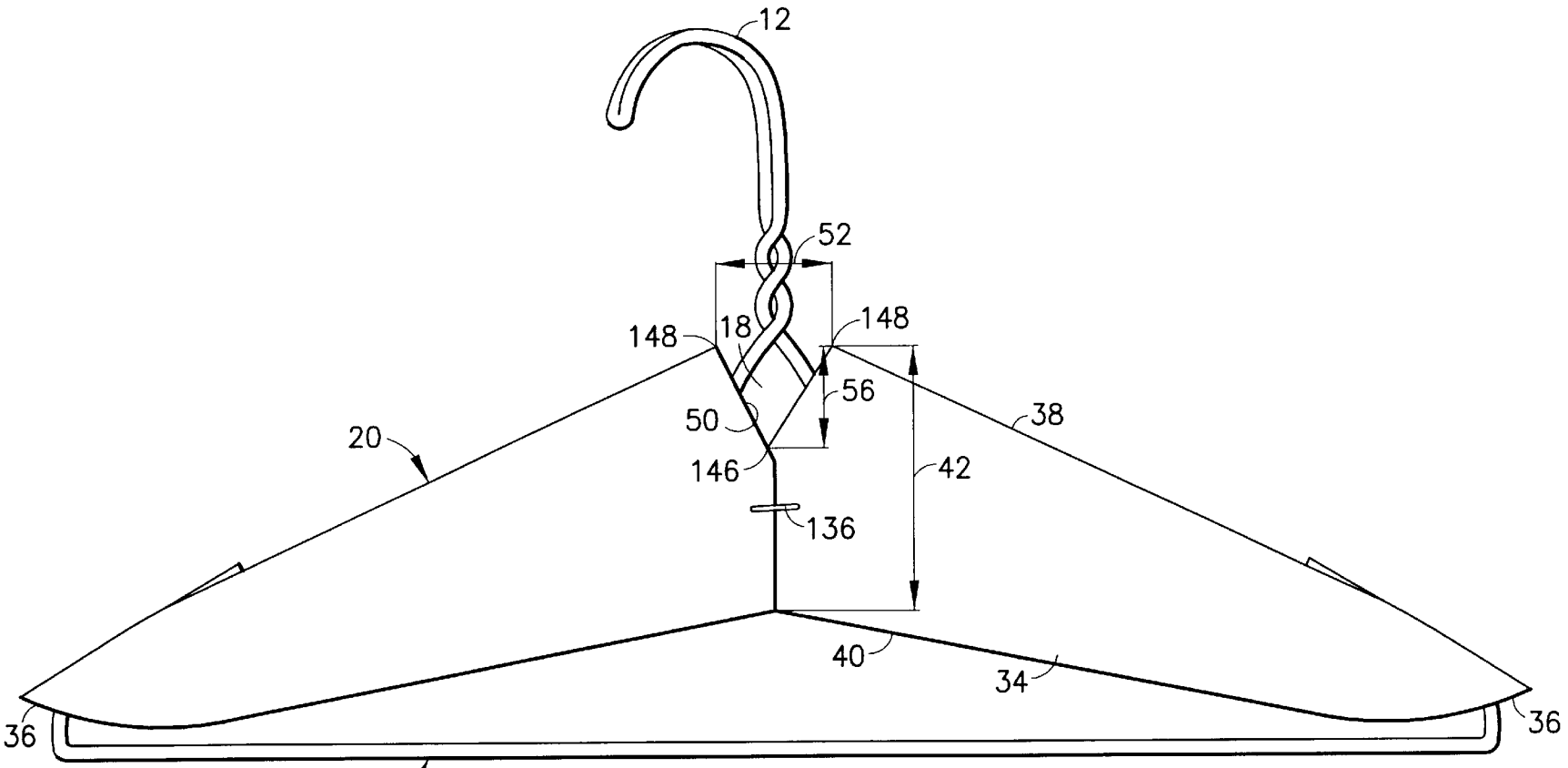
FIG. 3 is a rear elevational view of the shoulder guard assembled with the wire garment hanger.

Referring now to the drawing, and especially to FIGS. 1 through 3 thereof, a commonly available wire garment hanger is illustrated generally at 10 and is seen to include an altitudinally extending hook 12, shoulder supports 14 extending between the hook 12 and longitudinally opposite ends 16, and an open throat 18 extending altitudinally and longitudinally between the shoulder supports 14 and the hook 12. A shoulder guard constructed in accordance with the present invention is shown at 20 and is to be draped over the wire hanger 10 to rest upon the shoulder supports 14, as seen in FIGS. 2 and 3.

Shoulder guard 20 includes longitudinally opposite ends 22, a front panel 24 having longitudinally opposite front end edges 26, a front upper edge 28, a front lower edge 30, and an altitudinal height 32 between the front lower edge 30 and the front upper edge 28. A rear panel 34 has longitudinally opposite rear end edges 36, a rear upper edge 38, a rear lower edge 40, and an altitudinal height 42 between the rear lower edge 40 and the rear upper edge 38. A generally centrally located opening 50 receives the hook 12 when the shoulder guard 20 is draped over the shoulder supports 14 of the hanger 10, with the hook 12 extending through the opening 50, as illustrated in FIGS. 2 and 3.

Opening 50 extends longitudinally between the opposite ends 22 of the shoulder guard 20 over a longitudinal span 52 and extends altitudinally downwardly from the front upper edge 28 and from the rear upper edge 38 toward the front lower edge 30 and the rear lower edge 40, respectively, along respective altitudinal distances 54 and 56. The altitudinal distances 54 and 56, as well as the longitudinal span 52, are great enough so that upon draping the shoulder guard 20 over the shoulder supports 14 of the hanger 10, with the hook 12 of the hanger 10 extending altitudinally through the opening 50, the throat 18 of the hanger 10 is exposed sufficiently to provide ready access to the throat 18 for facilitating threading of a tie, such as wire twist-tie 60, through the throat 18.

Figure 4:
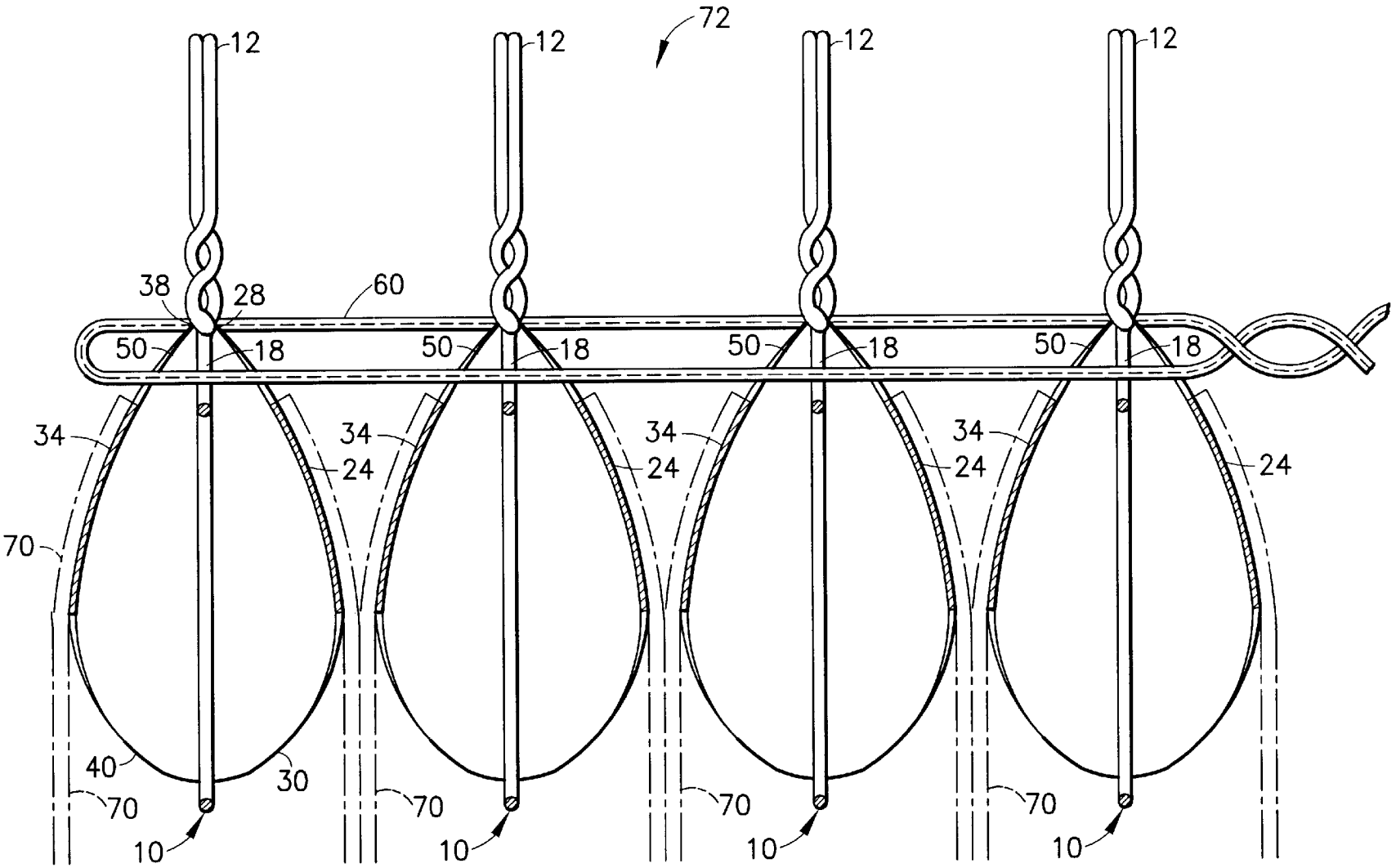
FIG. 4 is an enlarged end altitudinal cross-sectional view depicting a plurality of juxtaposed garments hung on adjacent wire garment hangers tied together with a common tie.

As seen in FIG. 4, a plurality of garments 70 are draped over corresponding assembled shoulder guards 20 and wire hangers 10 and are placed in a group 72 of juxtaposed garments 70 and corresponding adjacent hangers 10 and shoulder guards 20. The individual juxtaposed garments 70 and adjacent hangers 10 and shoulder guards 20 are integrated into group 72 by threading common twist-tie 60 through the throats 18 of the adjacent hangers 10 and then securing the hangers 10 together by twisting the twist-tie 60 in a well-known manner. The threading of the twist-tie 60 through the juxtaposed adjacent throats 18 is facilitated by the extent of the opening 50 which exposes the throats 18 sufficiently to ease insertion and movement of the twist-tie 60 through the throats 18. In a typical shoulder guard 20 having a longitudinal length between longitudinally opposite ends 22 of about seventeen inches, an opening 50 having a span 52 of at least about 0.5 inch and altitudinal distances 54 and 56 of at least about 0.75 inch provides sufficient exposure of the throat 18 to facilitate threading of the twist-tie 60 through the juxtaposed adjacent throats 18. Where the altitudinal heights 32 and 42 each are at least about two and one-half inches, the altitudinal distances 54 and 56 each are about thirty percent of the respective altitudinal heights 32 and 42. In those styles of shoulder guards in which the altitudinal heights are substantially greater than that of the illustrated shoulder guard 20, the altitudinal distances can be less than thirty percent of the altitudinal height, as long as the altitudinal distance is great enough to expose the throat of the wire hanger for facilitating threading of a tie through the throat. In any event, the ratio between altitudinal height and altitudinal distance must be such that the structural integrity of the erected shoulder guard is maintained. Accordingly, the altitudinal distances preferably are up to about thirty percent of the altitudinal heights.

Figure 5:
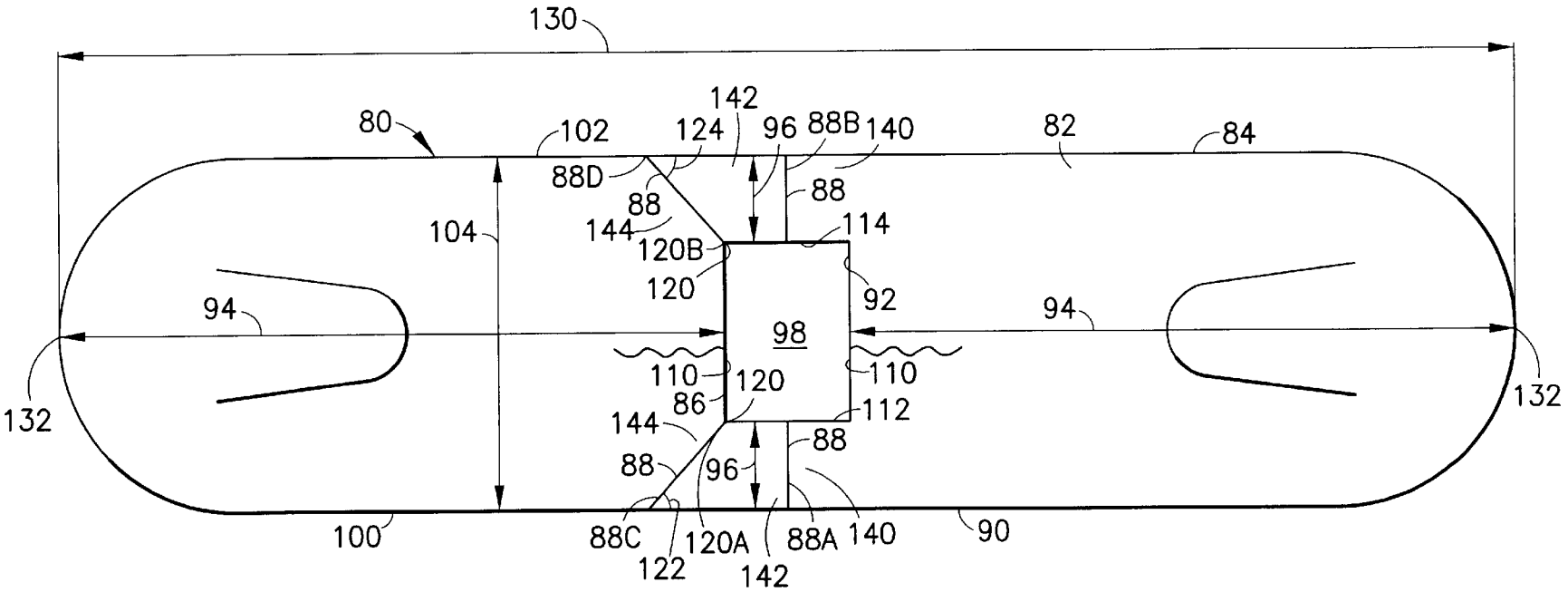
FIG. 5 is a top plan view of a blank for the shoulder guard.

Turning now to FIG. 5, a blank from which shoulder guard 20 is erected is illustrated at 80 and is constructed of a relatively inexpensive and expendable material having a resilience and durability commensurate with the performance required for the shoulder guard 20. A preferred material is paperboard card stock, of the type commonly used for shoulder guards. Blank 80 initially is in the form of an elongate essentially flat member 82 having an outer periphery 84, a generally central aperture 86, and fold lines 88 about which the blank 80 is to be folded to erect the shoulder guard 20 from the blank 80. A peripheral edge 90 extends around the entire blank 80, along the outer periphery 84, and the aperture 86 has a perimeter 92 extending around the entire aperture 86.

The perimeter 92 of the aperture 86 is spaced from the peripheral edge 90 of the blank 80 along longitudinal and lateral distances 94 and 96, respectively, for proscribing an area 98 spaced longitudinally and laterally from the peripheral edge 90 of the blank 80, the area 98 being great enough so that upon folding the blank 80 along the fold lines 88 to erect the shoulder guard 20, and upon draping the erect shoulder guard 20 over the shoulder supports 14 of the wire hanger 10, with the hook 12 extending through the aperture 86, which upon folding of the blank 80 becomes opening 50 of the shoulder guard 20, the throat 18 of the hanger 10 is exposed sufficiently for threading of the twist-tie 60 laterally through the throat 18 of each juxtaposed hanger 10 to tie together the juxtaposed hangers 10 and corresponding shoulder guards 20, all as described above.

The peripheral edge 90 of the blank 80 includes a front edge portion 100 and a rear edge portion 102 spaced laterally from the front edge portion 100 to establish a lateral width 104. In the preferred construction, aperture 86 is located essentially centrally between the front edge portion 100 and the rear edge portion 102 and has a generally rectangular configuration including lateral perimetric edges 110 extending laterally between the front edge portion 100 and the rear edge portion 102, a longitudinal perimetric edge 112 extending adjacent and generally parallel to the front edge portion 100, and a longitudinal perimetric edge 114 extending adjacent and generally parallel to the rear edge portion 102. The longitudinal perimetric edges 112 and 114 intersect the lateral perimetric edges 110 at corresponding corners 120. Fold lines 88 include a first fold line 88A extending laterally from the front edge portion 100 to longitudinal perimetric edge 112, generally perpendicular to the longitudinal perimetric edge 112; a second fold line 88B extending laterally from the rear edge portion 102 to longitudinal perimetric edge 114, generally perpendicular to longitudinal perimetric edge 114; a third fold line 88C extending from the front edge portion 100 to an adjacent corner 120A and making an acute angle 122 with the front edge portion 100; and a fourth fold line 88D extending from the rear edge portion 102 to an adjacent corner 120B and making an acute angle 124 with the rear edge portion 102. A typical blank 80 has a longitudinal length 130 between opposite ends 132 of about twenty inches and the lateral width 104 is about five inches. The lateral extent of the aperture 86 and, in this instance, the length of each lateral perimetric edge 110, is at least about two inches. The length of each perimetric edge 110 can occupy up to approximately forty percent of the lateral width 104 to assure structural integrity in the shoulder guard 20 to be erected from blank 80. The longitudinal extent of the aperture 86 and, in this instance, the longitudinal distance between lateral perimetric edges 110, or the longitudinal length of each of the longitudinal perimetric edges 112 and 114, is at least about 0.75 inch.

Blank 80 is erected into shoulder guard 20 by folding the blank 80 along the fold lines 88 to establish the full shoulder guard configuration illustrated in FIGS. 1 through 4. In the illustrated preferred construction, fasteners, such as staples 136, are employed to secure together portions 140, 142 and 144 of the blank 80, which portions 140 and 142 overlap one another in contiguous, confronting relationship upon folding along the fold lines 88, to maintain the shoulder guard 20 erect. As a result of such folding, the opening 50 established by the rectangular aperture 86 has a polygonal plan configuration, shown in the form of a diamond-shaped configuration with apices 146 located altitudinally low enough along the front and rear panels 24 and 34 of the shoulder guard 20, and apices 148 located longitudinally spaced apart far enough, to provide the desired access to the throat 18 of the hanger 10 for facilitating threading of the twist-tie 60.

While in the preferred embodiments illustrated herein and described in connection with FIGS. 1 through 5 shoulder guard 20 is shown having a particular style and configuration, it will be apparent that the advancement of the present invention is equally applicable to other shoulder guards having other styles and configurations, including a wide variety of currently available shoulder guard styles and configurations. Hence, the present invention is not to be construed as limited to the particular style and configuration of the illustrated shoulder guard 20.

It will be seen that the present invention attains the several objects and advantages summarized above, namely: Facilitates the use of a tie to secure together wire garment hangers over which shoulder guards are placed for supporting a plurality of juxtaposed garments on a group of adjacent corresponding wire garment hangers; provides wire garment hangers with all of the advantages of an appropriate shoulder guard while enabling the use of commonly available wire twist-ties to secure together a group of adjacent wire garment hangers with garments supported thereon; allows increased ease in securing together a plurality of garments hung on wire garment hangers for storage and transport as an integrated group; accommodates commonly available wire garment hangers without requiring modification or special skills; enables increased convenience in the handling of garments stored or transported on wire garment hangers; allows the use of a common tie to secure together a plurality of juxtaposed garments hung on adjacent wire garment hangers quickly, with increased ease and economy, and with a high degree of integrity and effectiveness.

It is to be understood that the above detailed description of preferred embodiments of the invention is provided by way of example only. Various details of design and construction may be modified without departing from the true spirit and scope of the invention, as set forth in the appended claims.

What is claimed is:

1. A blank from which a shoulder guard is erected for draping over a wire hanger having a central hook extending altitudinally, shoulder supports extending generally longitudinally between the hook and longitudinally opposite ends, and an open throat extending altitudinally and longitudinally between the hook and the shoulder supports, the blank being essentially flat and having an outer periphery, a generally central aperture for reception of the hook of the hanger, and fold lines about which the blank is folded to erect the shoulder guard for draping over the shoulder supports of the hanger when the hook is extended through the aperture, the blank enabling a plurality of laterally juxtaposed wire hangers with corresponding shoulder guards draped over the juxtaposed wire hangers to be tied together with a common tie, the blank comprising:

a peripheral edge extending around the entire blank, along the periphery of the blank; and the aperture having a perimeter extending around the entire aperture, the perimeter being spaced from the peripheral edge of the blank along longitudinal and lateral distances for proscribing an area spaced longitudinally and laterally from the peripheral edge of the blank, the area being great enough such that upon folding the blank along the fold lines to erect the shoulder guard and draping the erected shoulder guard over the shoulder supports of the wire hanger, with the hook of the wire hanger extending altitudinally through the aperture, the aperture is adapted for exposing the throat of the wire hanger sufficiently to easily facilitate threading of the common tie laterally through the throat of each of the plurality of juxtaposed wire hangers to tie together the juxtaposed wire hangers and corresponding shoulder guards.

2. The blank of claim 1 wherein the aperture has a plan configuration including a lateral extent of at least about two inches.

3. The blank of claim 1 wherein the peripheral edge includes a front edge portion and a rear edge portion spaced laterally from the front edge portion, the blank having a lateral width between the front edge portion and the rear edge portion, and the aperture is located essentially centrally between the front edge portion and the rear edge portion.

4. The blank of claim 3 wherein the aperture has a lateral extent of at least about two inches.

5. The blank of claim 3 wherein the aperture has a lateral extent of up to about forty percent of the lateral width of the blank.

6. The blank of claim 3 wherein the aperture has a generally rectangular configuration including lateral perimetric edges extending laterally between the front edge portion and the rear edge portion, the lateral perimetric edges having a length of at least about two inches.

7. The blank of claim 6 wherein the lateral perimetric edges are spaced apart longitudinally a distance of at least about 0.75 inch.

8. The blank of claim 3 wherein the aperture has a generally rectangular configuration including lateral perimetric edges extending laterally between the front edge portion and the rear edge portion, the lateral perimetric edges having a length of up to about forty percent of the lateral width of the blank.

9. The blank of claim 1 wherein the aperture has a generally rectangular plan configuration including lateral perimetric edges extending laterally across the blank and spaced laterally from the peripheral edges of the blank.

10. The blank of claim 9 wherein the rectangular plan configuration includes a first longitudinal perimetric edge extending adjacent and generally parallel to the front edge portion and a second longitudinal perimetric edge extending adjacent and generally parallel to the rear edge portion, the longitudinal perimetric edges intersecting the lateral perimetric edges at corresponding perimetric corners, and the fold lines include a first fold line extending laterally from the front edge portion to the first longitudinal perimetric edge, a second fold line extending laterally from the rear edge portion to the second longitudinal perimetric edge, a third fold line extending from the front edge portion to a corner located at the intersection between the first longitudinal perimetric edge and a lateral perimetric edge, and a fourth fold line extending from the rear edge portion to a corner located at the intersection between the second longitudinal perimetric edge and a lateral perimetric edge.

11. The blank of claim 10 wherein the first fold line is essentially perpendicular to the first longitudinal perimetric edge, and the second fold line is essentially perpendicular to the second longitudinal perimetric edge.

12. The blank of claim 11 wherein the third fold line extends at an acute angle to the front edge portion, and the fourth fold line extends at an acute angle to the rear edge portion.

13. A shoulder guard for draping over a wire hanger having a central hook extending altitudinally, shoulder supports extending generally longitudinally between the hook and longitudinally opposite ends, and an open throat extending altitudinally and longitudinally between the hook and the shoulder supports, the shoulder guard including longitudinally opposite ends, a front panel having longitudinally opposite front end edges, a front upper edge, a front lower edge, and an altitudinal height between the front lower edge and the front upper edge, a rear panel having longitudinally opposite rear end edges, a rear upper edge, a rear lower edge, and an altitudinal height between the rear lower edge and rear upper edge, and a generally central opening for reception of the hook of the hanger when shoulder guard is draped over the shoulder supports of the hanger with the hook extending through the opening, the shoulder guard enabling a plurality of laterally juxtaposed wire hangers with corresponding shoulder guards draped over the juxtaposed wire hangers to be tied together with a common tie, the shoulder guard comprising:

the opening extending longitudinally between the longitudinally opposite ends and extending altitudinally downwardly from the front upper edge and the rear upper edge toward the front lower edge and the rear lower edge along altitudinal distances great enough such that upon draping the shoulder guard over the shoulder supports of the wire hanger, with the hook of the wire hanger extending altitudinally through the opening, the opening is adapted for exposing the throat of the wire hanger sufficiently to easily facilitate threading of the common tie laterally through the throat of each of the Plurality of juxtaposed wire hangers to tie together the juxtaposed wire hangers and corresponding shoulder guards.

14. The shoulder guard of claim 13 wherein the altitudinal distances are at least about 0.75 inch.

15. The shoulder guard of claim 13 wherein the altitudinal distances are up to about thirty percent of the altitudinal height of the corresponding front and rear panels.

16. The shoulder guard of claim 13 wherein the opening has a polygonal plan configuration.

17. The shoulder guard of claim 16 wherein the polygonal plan configuration is diamond-shaped.

* * * * *